United States Patent [19]

Urataki et al.

[11] Patent Number: 4,967,118

[45] Date of Patent: Oct. 30, 1990

[54] NEGATIVE GLOW DISCHARGE LAMP

[75] Inventors: Etsuo Urataki; Masaroshi Kodama, both of Tokyo; Hiromitsu Matsuno, Hachioji, all of Japan

[73] Assignee: Hitachi, Ltd., Tokyo, Japan

[21] Appl. No.: 321,066

[22] Filed: Mar. 9, 1989

[30] Foreign Application Priority Data

Mar. 11, 1988 [JP] Japan ..... 63-56056

[51] Int. Cl.[5] ..... H01J 61/4; H01J 61/30; H01J 61/54; H05B 41/18

[52] U.S. Cl. ..... 315/56; 315/59; 315/205; 313/619; 313/620; 313/634; 313/642

[58] Field of Search ..... 315/33, 50, 56, 58, 315/59, 200 R, 205, 207, 326, 358, DIG. 7; 313/310, 317, 318, 619, 620, 634, 642

[56] References Cited

U.S. PATENT DOCUMENTS 4,001,637 1/1977 Gray ..... 315/247
4,879,493 11/1989 Matsuno et al. ..... 313/641

FOREIGN PATENT DOCUMENTS 63-19750 1/1988 Japan .

*Primary Examiner*—David Mis
*Attorney, Agent, or Firm*—Fay, Sharpe, Beall, Fagan, Minnich & Mckee

[57] ABSTRACT

A negative glow discharge lamp of small size comprising a cylindrical discharge container enclosing at least rare gas, a hot cathode disposed in the discharge container and coated with a thermion radiation matter, and an anode disposed in a negative glow domain formed between the anode and the hot cathode in the discharge container. In the discharge lamp, the outer diameter D (mm) of the discharge container is selected to satisfy the relation $$3\,W_L < D < 10\,W_L$$

where $W_L$ the electric power consumption (W) of the discharge lamp when the length L (mm) of the discharge container lies within the range of L=25 to 100 mm.

5 Claims, 1 Drawing Sheet

NEGATIVE GLOW DISCHARGE LAMP

BACKGROUND OF THE INVENTION

This invention relates to a negative glow discharge lamp of small size, and more particularly to a lamp structure which is suitable for preventing undesirable degradation of lamp operation characteristics due to occurrence of graphitization while the lamp is in operation.

A low voltage electric discharge lamp of small size having at least one pair of electrodes and discharging gas enclosed in a tightly formed discharge container is disclosed in JP-A No. 63-19750. The disclosed discharge lamp employs an electrode arrangement in which, when one of the electrodes acts as an anode, the electrode acting as the anode is located in a negative glow domain so as to ensure zero anode drop voltage. Through the employment of the electrode arrangement described above, both the lamp voltage and the discharge voltage of the low voltage electric discharge lamp of small size can be lowered to increase the luminous efficiency of the discharge lamp.

For such a type discharge lamp, U.S. Pat. No. 4,879,493 may be referred to which is entitled "Low-pressure discharge lamp" to Matsuno et al and assigned to Hitachi, Ltd. The inventors of the present invention disclose improvements for stabilizing electrical characteristics and broadening frequency range of such a discharge lamp in U.S. Pat. application No. 321,069, filed Mar. 9, 1989 entitled "Negative glow discharge lamp device" and assigned to Hitachi, Ltd.

The size of the discharge lamp described above is sufficiently small when used as an ordinary fluorescent lamp. However, the outer diameter of the glass tube forming the discharge container is relatively large, and it may be frequently impossible to insert the discharge lamp into, for example, a very narrow space in which the discharge lamp is to be installed. Further, the foregoing type discharge lamp is still insufficient in its operation characteristics, especially, in the aspect of preventing undesirable graphitization of the glass tube due to scattering of thermion radiation matter.

SUMMARY OF THE INVENTION

With a view to obviate the defects pointed out above, it is an object of the present invention to provide a low voltage electric discharge lamp of small size which can be installed even in a very narrow space and whose useful service life is not shortened due to, for example, graphitization.

The present invention which attains the above object provides a low voltage electric discharge lamp comprising at least one pair of electrodes and discharging gas enclosed in a tightly formed discharge container in the form of a glass tube and having an electrode arrangement in which, when one of the electrodes acts as an anode, the electrode acting as the anode is located in a negative glow domain, wherein the outer diameter D of the glass tube is selected to satisfy a predetermined relation between it and the electric power $W_L$ of the lamp when the length L of the glass tube lies within a predetermined range.

That is, when a predetermined relation as described later is established between the electric power $W_L$ of the lamp and the outer diameter D of the glass tube in a predetermined range of the length L of the glass tube, the upper limit of the tube diameter D can be selected to be a minimum, while the lower limit of the tube diameter D can be set at a desired value which minimizes occurrence of undesirable graphitization until the end of the useful service life of the lamp.

DESCRIPTION OF THE PREFERRED EMBODIMENTS

Figure 1:
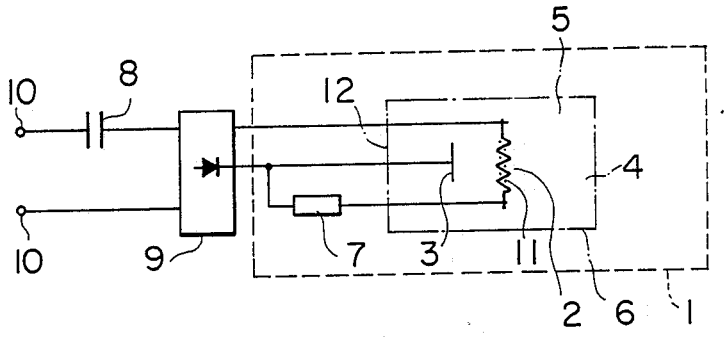
FIG. 1 shows schematically the structure of an embodiment of the low voltage electric discharge lamp of small size according to the present invention, together with a wiring diagram of its lighting device.

FIG. 1 shows schematically the structure of an embodiment of the low voltage electric discharge lamp of small size according to the present invention, together with a wiring diagram of its lighting device. Referring to FIG. 1, the low voltage electric discharge lamp generally designated by the reference numeral 1 comprises a glass tube for luminescence (a discharge container) 6 and a starting device 7. A hot cathode 2, an anode 3, mercury 4 and rare gas 5 are enclosed in the glass tube 6. A lighting device including a current control ballast 8, such as a capacitor, and a rectifier 9 is additionally provided for the electric discharge lamp 1. An a.c. voltage applied across power input terminals 10 is applied through the capacitor ballast 8 to the rectifier 9 where the a.c. voltage is full-wave rectified, and the d.c. output voltage of the rectifier 9 is applied across the starting device 7 through the hot cathode 2. The starting device 7 includes a switching element such as a nonlinear switching semiconductor element whose resistance decreases to a value nearly equal to zero when a voltage higher than a predetermined level is applied. Because the resistance of the starting device 7 decreases to its zero resistance level as soon as the d.c. power supply voltage is applied thereacross, pre-heating current starts to flow through the hot cathode 2. As a result, thermions are easily radiated from the hot cathode 2. On the other hand, the same d.c. power supply voltage is also applied across the hot cathode 2 and the anode 3 located in a negative glow domain. Thereafter, electric discharge occurs immediately between the anode 3 and the hot cathode 2, and, after this discharge is started, the d.c. voltage applied across the anode 3 and the hot cathode 2 decreases to a low level of about 9 V. The operation described above is completed within a period of time of 0 to 0.5 sec after the d.c. power supply voltage is applied, and the voltage applied across the starting device 7 thereafter has the level of about 9 V described above. Therefore, the resistance of the starting device 7 is substantially restored to its initial infinitely large value, and the discharge lamp 1 sustains its stable electric discharge. The above description explains the situation of the discharge lamp 1 in the discharge starting mode, and electrons flow out continuously from the hot cathode 2 toward the anode 3. As the discharge lamp 1 operates for a long lighting time, a thermion radiation matter 11 coated on the hot cathode 2 scatters and attaches to the inner wall surface of the glass tube 6 in a progressively increasing amount thereby tending to cause graphitization of the glass tube 6. As a result, the quantity of luminescence emitted from the discharge will be markedly decreased.

Figure 2:
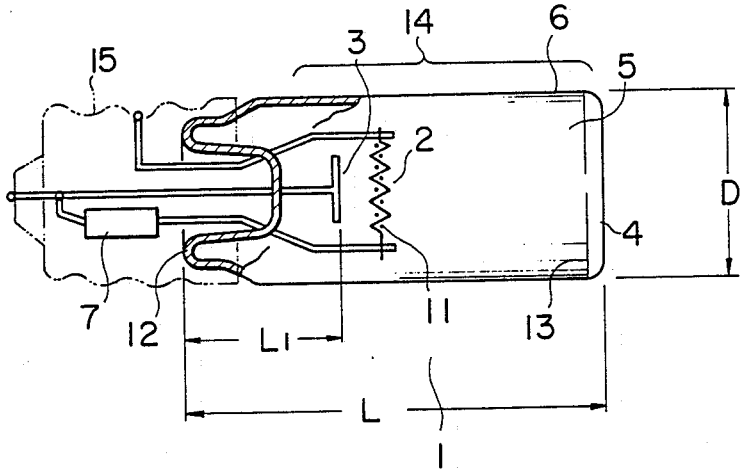
FIG. 2 is a partly sectional, schematic elevational view of the lamp shown in FIG. 1.

According to the results of an experiment conducted by the inventors, it was found out that a relation as described below had to be satisfied in order to avoid the undesirable decrease in the quantity of luminescence due to the graphitization described above. In FIG. 2, the glass tube 6 for luminescence has an outer diameter D (mm) and a total length L (mm), and electric power consumed in the glass tube 6, that is, the electric power of the discharge lamp 1 is $W_L$ (W). Then, the following relation must be satisfied within the range of L =25 to 100 mm:

$$3\,W_L < D \ldots\ldots \quad (1)$$

On the other hand, in order that the discharge lamp 1 has a sufficiently small size intended by the inventors, the following relation must also be satisfied:

$$D < 10\,W_L \ldots\ldots \quad (2)$$

Further, when the glass tube 6 for luminescence has a cylindrical sectional shape, the content volume of the glass tube 6 can be maximized while satisfying the relation given by the expression (2).

From the expressions (1) and (2), it can be concluded that the desired operation characteristics of the discharge lamp 1 can be obtained when the following relation is satisfied within the range of L=25 to 100 mm:

$$3\,W_L < D < 10\,W_L \ldots\ldots \quad (3)$$

In the last stage of the useful service life of the discharge lamp 1 operated for a long lighting time, occurrence of slight graphitization of the glass tube 6 is inevitable. In such a case, the temperature of a most cooled section 12 forming part of the glass tube 6 of the discharge lamp 1 tends to rise due to this graphitization, resulting frequently in a great variation of the luminescence characteristic of the discharge lamp 1. The most cooled section 12 described above coincides with the end of the glass tube 6 where a base 15 is mounted.

The inventors found out that disposition of the anode 3 at a position as described below was effective for solving the above problem and maintaining the luminescence characteristic to be substantially equivalent to the initial value. In a second embodiment of the present invention which meets the above requirement, the distance $L_1$ between the anode 3 and the most cooled section 12 is selected to satisfy the following relation, as shown in FIG. 2.

$$\frac{L}{2} - 5 \leqq L_1 \leqq \frac{L}{2} + 4\ (\text{mm}) \quad (4)$$

By so selecting the value of the distance $L_1$, the temperature of the most cooled section 12 can be maintained at its optimum value of about 40° C., and the temperature at the other end 13 of the glass tube 6 can be maintained at about 45 to 50° C. After the discharge lamp 1 is operated for a long lighting time until graphitization occurs in the glass tube 6, this graphitization occurs initially in the vicinity of the most cooled section 12, and the temperature of the most cooled section 12 rises due to the graphitization. As a result, the mercury 4 staying at the most cooled section 12 starts to migrate toward the other end 13 of the glass tube 6. Although the temperature at the other end 13 of the glass tube 6 is as high as about 45 to 50° C., the luminescence characteristic of the discharge lamp 1 does not change appreciably and is maintained stable till the end of the useful service life of the discharge lamp 1. Therefore, any substantial graphitization does not occur on a section 14 used for luminescence, and stable luminescence can be obtained.

On the other hand, when the distance $L_1$ between the anode 3 and the most cooled section 12 of the glass tube 6 is given by the relation $$L_1 < \frac{L}{2} - 5, \quad (5)$$

the temperatures at the most cooled section 12 and glass tube end 13 have values contrary to those described above. That is, the most cooled section 12 has a temperature of about b 45 to 50° C., while the other end 13 of the glass tube 6 has a temperature of about 40° C. Although the initial luminescence characteristic of the discharge lamp 1 is the same as when the distance $L_1$ is given by the relation $$\frac{L}{2} - 5 \leqq L \leqq \frac{L}{2} + 4\ (\text{mm}),$$

the temperature at the most cooled section 12 is now as high as about 45 to 50° C., while the temperature at the other end 13 of the glass tube 6 is now as low as about 40° C. Therefore, graphitization tends to occur in the vicinity of the glass tube end 13 having a lower temperature. The inventors found that the greater part of the section 14 used for luminescence of the glass tube 6 was covered with a graphitization layer within a short period of time, resulting in a decreased quantity of luminescence.

Also, when the distance L1 between the anode 3 and the most cooled section 12 of the glass tube 6 is given by $$L_1 > \frac{L}{2} + 4, \quad (6)$$

the temperature at the most cooled section 12 is excessively low, and the discharge lamp 1 cannot emit the desired quantity of luminescence.

In FIG. 2, the starting device 7 is built in the base 15.

According to the first embodiment of the discharge lamp of the present invention, the relation between the outer diameter D of the glass tube 6 and the electric power the discharge lamp 1 is selected to satisfy the relation given by the expression (3), so that the discharge lamp can stably operate with least graphitization until the end of its useful service life, and the outer diameter D of the glass tube 6 can be minimized.

According to the second embodiment of the discharge lamp of the present invention, the anode 3 is disposed at the position given by the expression (4), so that the temperature at the position of the mercury 4 can be substantially maintained constant, and the luminescence characteristic of the discharge lamp can be maintained stable till the end of the useful service life.

A phosphor may be coated on the inner wall surface of the glass tube 6 for luminescence. Alternatively, the glass tube 6 may be made of an ultraviolet-ray transmitting glass, and no phosphor may be coated on the inner wall surface of the glass tube 6 to provide an ultraviolet generating lamp. A base 15 is mounted on one end of the discharge container and the starting device is built in the base 15 for obtaining a compact structure.

We claim:

1. A negative glow discharge lamp comprising a cylindrical discharge container enclosing at least rare gas, a hot cathode disposed in said discharge container and coated with a thermion radiation matter, and an anode disposed in a negative glow domain formed between said anode and said hot cathode in said discharge container, wherein the outer diameter D (mm) of said discharge container is selected to satisfy the relation $$3\,W_L < D < 10\,W_L$$

where $W_L$ is the electric power consumption (W) of said discharge lamp when the length L (mm) of said discharge container lies within the range of L=25 to 100 mm.

2. A negative glow discharge lamp according to claim 1, wherein the distance $L_1$ (mm) between said anode and the base-side end of said discharge container is selected to satisfy the relation $$\frac{L}{2} - 5 \leqq L_1 \leqq \frac{L}{2} + 4.$$

3. A negative glow discharge lamp according to claim 1, wherein a starting device is connected between said hot cathode and said anode for starting electric discharge in said discharge container.

4. A negative glow discharge lamp according to claim 2, wherein a starting device is connected between said hot cathode and said anode for starting electric discharge in said discharge container.

5. A negative glow discharge lamp according to claim 3, wherein a base is mounted on one end of said discharge container, and said starting device is built in said base.

* * * * *